US007000359B2

(12) United States Patent
Meyer

(10) Patent No.: US 7,000,359 B2
(45) Date of Patent: Feb. 21, 2006

(54) FLEXIBLE THERMALLY INSULATIVE AND WATERPROOF BARRIER

(76) Inventor: Donald L. Meyer, 105 Alvin St., East Peoria, IL (US) 61611

( * ) Notice: Subject to any disclaimer, the term of this patent is extended or adjusted under 35 U.S.C. 154(b) by 0 days.

(21) Appl. No.: 10/622,171

(22) Filed: Jul. 17, 2003

(65) Prior Publication Data

US 2005/0011133 A1 Jan. 20, 2005

(51) Int. Cl.
*E04C 1/00* (2006.01)

(52) U.S. Cl. ..... 52/309.9; 52/506.01; 52/309.17; 52/414

(58) Field of Classification Search ..... 52/3, 52/5, 63, 309.15, 202, 222, 23, DIG. 12, 52/DIG. 14, 794.1, 309.9, 309.17, 381, 382, 52/414, 741.41, 2.15, 2.24, 408, 409, 506.01; 428/74, 71, 76, 137, 68, 69; 150/154
See application file for complete search history.

(56) References Cited

U.S. PATENT DOCUMENTS

| | | | | |
|---|---|---|---|---|
| 2,146,775 | A | 2/1939 | Stoutenburgh | |
| 2,899,771 | A | 8/1959 | Burris | |
| 3,162,566 | A * | 12/1964 | Katz | 428/74 |
| 3,420,022 | A * | 1/1969 | Brook | 52/302.1 |
| 3,425,889 | A | 2/1969 | Willits, Jr. | |
| 3,793,795 | A | 2/1974 | Annand | |
| 3,832,263 | A | 8/1974 | Cleveland et al. | |
| 4,142,344 | A | 3/1979 | Palmaer | |
| 4,530,193 | A * | 7/1985 | Ochs | 52/408 |
| 4,590,714 | A * | 5/1986 | Walker | 250/585 |
| 4,622,790 | A | 11/1986 | Johansson | |
| 4,675,225 | A * | 6/1987 | Cutler | 428/74 |
| 4,774,794 | A * | 10/1988 | Grieb | 52/309.7 |
| 4,943,185 | A | 7/1990 | McGuckin et al. | |
| 5,067,298 | A * | 11/1991 | Petersen | 52/742.14 |
| 5,248,225 | A | 9/1993 | Rose | |
| 5,379,555 | A * | 1/1995 | Strieb et al. | 52/3 |
| 5,495,696 | A | 3/1996 | Repka | |
| 5,617,687 | A | 4/1997 | Bussey, Jr. et al. | |
| 6,182,412 | B1 | 2/2001 | Traxler | |
| 6,189,279 | B1 | 2/2001 | Fiechtl | |
| 6,261,397 | B1 * | 7/2001 | Repp et al. | 156/93 |
| 6,329,038 | B1 * | 12/2001 | Christoffersen | 428/68 |
| 2004/0074152 | A1 * | 4/2004 | Rogers et al. | 52/3 |

* cited by examiner

*Primary Examiner*—Naoko Slack
(74) *Attorney, Agent, or Firm*—Amster, Rothstein & Ebenstein

(57) ABSTRACT

A thermally insulative and waterproof barrier for protecting an exterior surface includes a plurality of generally rectangular flexible blankets in overlapping disposition. Each blanket defines a body and a peripheral margin about edges of the body, edges of the bodies of adjacent blankets (including the base layer) overlapping. Each body includes at least one base layer of thermal insulation and two cover layers of waterproof material. The cover layers are sealed together peripherally about the base layer to form the peripheral margin and exclude water from the base layer.

15 Claims, 4 Drawing Sheets

12
12
12

FLEXIBLE THERMALLY INSULATIVE AND WATERPROOF BARRIER

BACKGROUND OF THE INVENTION

The present invention relates to a thermally insulative and waterproof barrier for protecting an exterior surface and, more particularly, to such a barrier which is flexible.

It is known in the construction art to provide a thermally insulative and waterproof barrier for protecting an exterior surface of a structure, whether the structure be a slab, a foundation, or a wall. Typically, the barrier is substantially inflexible so that the several pieces forming the barrier, when being installed, are placed both side-by-side and end-to-end to form butt joints. When butting the barrier pieces, the butting joints will be loose and, as a result, the barrier in the joint area is less effective. Thus, moisture and cold air can work its way into and through the joint, thereby reducing or eliminating the desired moisture and thermal barrier protection. The barrier cannot conform itself to the subsoil or the foundation, but only hits or rests on the high spots, thereby leaving voids under the barrier which can lead to breaking of the barrier in unsupported areas and possibly even structural problems with respect to concrete or other material poured thereover since the material is not installed to an even thickness.

On the other hand, overlapping of substantially inflexible barrier pieces creates an unattractive appearance, allows ambient winds to drive under a barrier piece to blow it out of position, and precludes the use of conventional flashing over the barrier. Most importantly, overlapping barrier pieces may interfere with formation of an operatively continuous barrier as substantially inflexible barrier pieces will not substantially conform peripherally to a subsoil, foundation or wall, as necessary to provide an operatively continuous barrier. Additionally, because of the voids caused by such overlapping of substantially inflexible barrier pieces at and adjacent the overlap, even the limited amount of walking on the barrier required for installation purposes may break the barrier pieces and thereby reduce the desired barrier properties.

As both butting joints and overlapping joints are not entirely satisfactory, the industry has for the most part used butting joints, but then sealed the butt joints, for example, with an adhesive sealing tape or like sealant. For the tape or like sealant to be properly bonded with the butt joint, the exposed butt joint surface must be clean so as to be free of dirt, dust, etc. In addition to the cost of the sealing tape or like sealant, substantial time and labor must be expended to operatively seal the butt joints, thereby increasing the effective cost of the barrier.

Additionally, in the known barrier materials, the thermal insulation within is not operatively sealed against exposure to moisture, which can deleteriously affect certain types of thermal insulation, such as aluminum.

Accordingly, it is an object of the present invention to provide a thermally insulative and waterproof barrier for protecting an exterior surface using a plurality of flexible blankets having overlapping edges, thereby to avoid the extra cost involved with the time, labor and materials required for sealing of butt joints.

Another object is to provide such a barrier which in a preferred embodiment will substantially conform to a subsoil, foundation, or wall to provide an operatively continuous barrier.

A further object is to provide such a barrier wherein in a preferred embodiment the thermal insulation is sealed against attack by moisture.

It is also an object of the present invention to provide a barrier which in a preferred embodiment is simple and inexpensive to manufacture and use.

SUMMARY OF THE INVENTION

It has now been found that the above and related objects of the present invention are obtained in a thermally insulative and waterproof barrier for protecting an exterior surface, comprising a plurality of generally rectangular flexible blankets. Each blanket defines a central body and a peripheral margin about the edges of the body. Edges of the bodies of adjacent blankets overlap. The body includes at least one base layer of thermal insulation and two cover layers of waterproof material, the cover layers being sealed together peripherally about the base layer to form the peripheral margin and to exclude water from the base layer.

In a preferred embodiment, the blankets are disposed with adjacent blankets forming only a single pair of mutually overlapping edges. At least one of the blankets has all four edges overlapping the edges of other blankets. Preferably, the overlapping edges (including the base layer) overlap by at least 1.5 inches and by not more than 4.0 inches.

In another preferred embodiment, the peripheral margin of each blanket is seamed and includes grommets extending therethrough. Securing means extend through at least some of the grommets for securing each blanket to one of a substrate, a structural frame, and another blanket. A plurality of fixation means extend through each blanket body in order to fix the relative position of the base layer relative to the cover layers.

Preferably each blanket is sufficiently flexible to be rollable into a generally cylindrical configuration, each blanket having a thickness of not more than 1.5 inches. Preferably the thermal insulation includes at least one metallized surface of at least one cover layer. Preferably the waterproof material is sheet-like, moistureproof and optionally impervious to soil gas.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
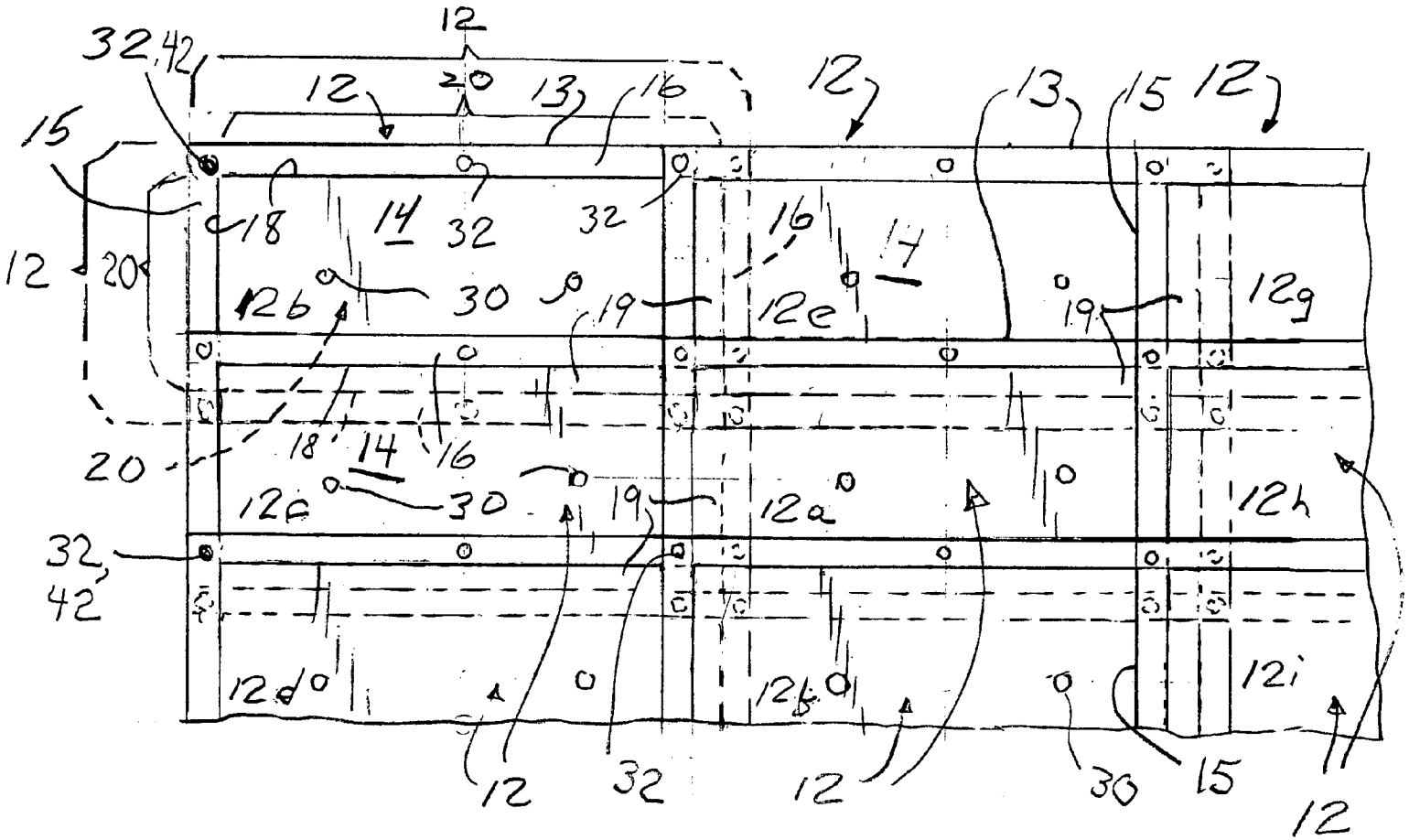
FIG. 1 is a fragmentary top plan view of a preferred layout of overlapping flexible blankets to form a barrier according to the present invention.

Referring now to the drawing, and in particular to FIG. 1 thereof, therein illustrated is a thermally insulative and waterproof barrier according to the present invention, generally designated by the reference numeral 10. The barrier 10 is intended for the protection of an exterior (not shown)—for example, a slab, foundation, wall or like structure, whether formed of concrete, brick or like construction material—against both heat (and loss of heat) and moisture. The term "exterior" is used herein and in the claims to broadly refer to any or all of the outer surfaces, including the sides, top and bottom.

The barrier 10 is comprised of a plurality of generally rectangular, substantially flexible blankets, generally designated 12, nine full blankets being illustrated in FIG. 1. Each blanket 12 defines a central body 14 having edges 18 and a peripheral margin 16 extending about the edges 18. The blankets 12 forming the barrier 10 are disposed relative to one another such that adjacent blankets 12 have overlapping central body edges 18, the overlap being indicated by the numeral 19. The overlapping central body edges 18 of adjacent blankets 12 may be on a longitudinal side 13 thereof, on a transverse end 15 thereof, or both. The term "overlapping" is used herein and in the claims in its broad sense and includes both edges which go over other edges and edges which go under other edges.

Accordingly, the peripheral margin 16 and central body edges 18 of the centrally disposed blanket 12*a* overlaps to some degree each of the eight contiguous blankets 12*b* through 12*i*. By way of contrast, a more isolated corner blanket 12*b* may overlap only three contiguous blankets 12*c*, 12*a* and 12*e*, with the free edges 18 typically overlapping a wood construction frame or the like (not shown). In other words, while at least one of the blankets 12 has all four central body edges 18 overlapping the edges 18 of other blankets 12, other blankets 12 may have only two central body edges 18 overlapping other blankets 12.

Preferably the overlapping edges 18 of the central bodies 14 of blankets 12 overlap by at least 1.5 inches and not more than 4.0 inches to provide an effective barrier seal, although lesser and greater overlaps may be preferred in certain applications. Of course, the peripheral margins 16 overlap even more.

While the blankets have been illustrated as being of a common size and configuration, clearly they may be provided in a variety of different sizes and configurations so that, with little if any modification, a variety of pre-sized and pre-configured blankets can be deployed to fully occupy the desired site.

Figure 2:
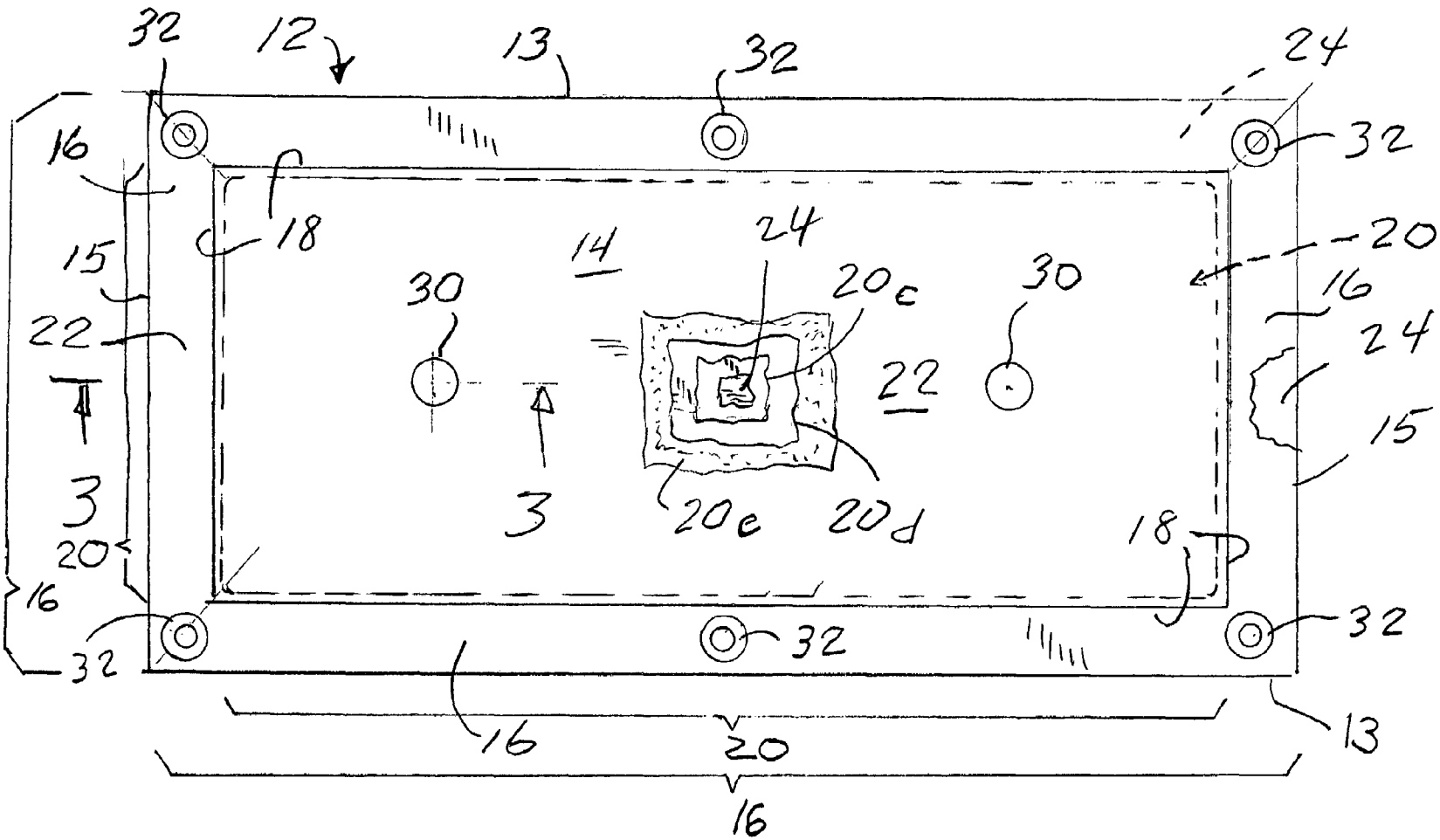
FIG. 2 is a top plan view, to an enlarged scale, of a single blanket, with portions thereof removed to reveal details of internal construction.
Figure 3:
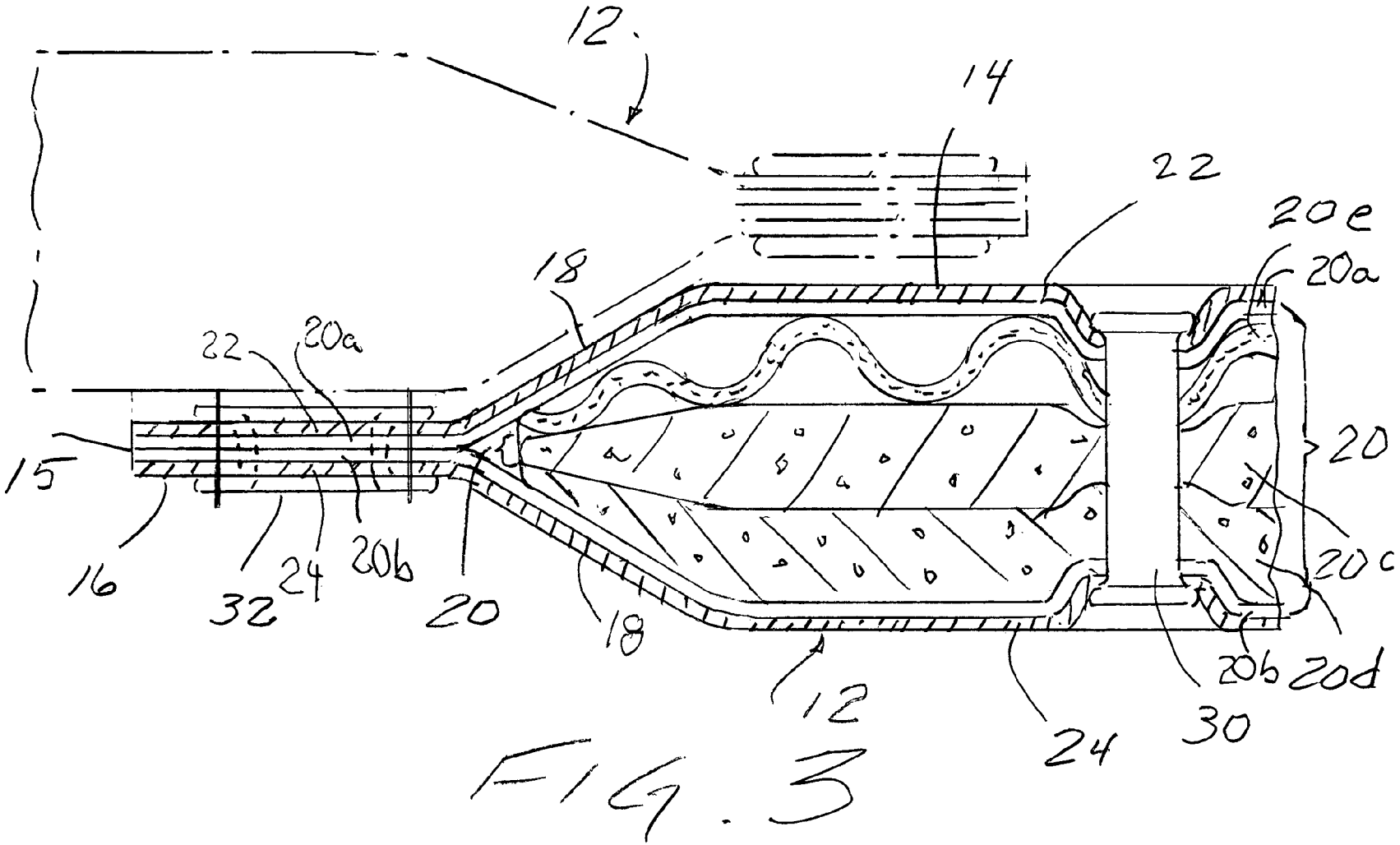
FIG. 3 is a fragmentary sectional view thereof taken along the lines 3—3 of FIG. 2.

Referring now to FIGS. 2 and 3 in particular, the central body 14 of each blanket 12 includes at least one base layer 20 of thermal insulation and two outer cover layers 22, 24 of waterproof material. The cover layers 22, 24 extend beyond the base layer 20 and are sealed together (e.g., heat sealed) and/or seamed (e.g., sewn or stitched together) peripherally about the edges 18 of the base layer 20 to form the peripheral margin 16, thereby to exclude water and water vapor from the base layer 20. Preferably the cover layers 22, 24 are coextensive.

The waterproof material of cover layers 22, 24 can be made of one or more different types of sheet-like barrier materials which are effective against both water vapor and liquid water. The term "waterproof" as used herein and in the claims refers to a barrier against both liquid and gaseous water (i.e., against both liquid water and water vapor). The material used must be flexible and have a permeability rating of less than 1 (by Water Vapor Transmission Test ASTM-E96) so that it is considered as a vapor barrier or vapor retarder. Preferred waterproof materials include polyethylene, polyvinyl, polypropylene, polyester, combinations thereof, sheeting made therefrom, and the like, whether or not metallized (for example, with light gauge aluminum). The waterproof cover layers 22, 24 are preferably not only moistureproof, but also impervious to soil gases such as radon, methane and the like.

The thermal insulation base layer 20 can be made of one or more conventional types of insulating materials. The key factor is, of course, that it must be sufficiently flexible so that it can be rolled and sufficiently thin that snugly overlapping joints can be made.

Preferred materials for base layer 20 include the flexible foams formed of polyethylene, polypropylene, polystyrene, polyurethane, polyester, and the like, whether used in sponge, foam or bubble wrap layer form. As clearly illustrated in FIG. 3, a preferred base layer 20 according to the present invention includes an outer pair of aluminized surface sub-layers 20*a*, 20*b* (on the facing inner surfaces of the cover layers 22, 24), an inner pair of foam sub-layers 20*c*, 20*d* (whether open-cell or closed-cell foam), and a bubble wrap sub-layer 20*e* (either to one side of the pair of foam sub-layers 20*c*, 20*d* or therebetween). These five sub-layers 20*a*–20*e* may be laminated together to form a unitary base layer or merely lie in close juxtaposition. Thus, in a preferred construction of the blanket 12, the base layer 20 comprises the aluminized inner surfaces 20*a*, 20*b* of the cover layers 22, 24, and, intermediate the aluminized surfaces 20*a*, 20*b*, at least two sub-layers 20*c*, 20*d* of foam and at least one sub-layer 20*e* of bubble pack. The base layer 20 may, of course, consist of fewer or more than five sub-layers.

As moisture is excluded from the thermal insulation base layer 20 by the sealed waterproof cover layers 22, 24, the base layer 20 may be formed in part of aluminum—for example, thin aluminum foil adhered to the inner surface of each waterproof cover layer 22, 24. Aluminum, a highly effective insulator or reflector of radiant heat, is infamous for becoming dirty, dusty, dull or damaged during the typical construction process and thereafter. In the present invention, the aluminum of surfaces 20*a*, 20*b* is sealed within the blanket 12, and in particular the envelope formed by the cover layers 22, 24, so that it is protected from direct contact with dirt, wet concrete or other moisture sources which may adversely affect it. Where the aluminum is an aluminized surface 20*a*, 20*b* on the inner surface of the cover layers 22, 24, it may be expedient to extend the aluminized surfaces 20*a*, 20*b* out into the peripheral margins 16 along with the cover layers 22, 24, as illustrated. Alternatively, the aluminized surfaces 20*a*, 20*b* may be co-extensive only with the base layer 20 (that is, not extend into the peripheral margins 16).

Preferably the central body 14 of each blanket 12 has a thickness of not more than 1.5 inches. Thus, the thickness increase of an overlapped joint (relative to that of a single blanket 12) is at most 1.5 inches except for those corners where three blankets 12 overlap and the corner overlap is at most 3.0 inches.

In order to prevent shifting of the base layer 20 within the envelope formed by the cover layers 22, 24, a plurality of fixation means 30 (best illustrated in FIGS. 2 and 3) preferably extend through the central body 14 of each blanket 12, thereby to fix the relative position of the base layer 20 relative to the cover layers 22, 24. The fixation means 30 may be a simple solid plastic rod extending through the body 14 and held in place by means of enlarged heads or buttons affixed thereto outwardly of the cover layers 22, 24.

In order to fix the blanket peripheral margins 16 in place—either to a substrate or a framework—grommets 32 preferably extend through each peripheral margin 16 of each blanket 12. The grommets 32 pass through the cover layers 22, 24 (but not the base layer 20) and are used to fix the relative position of the blankets 12 with respect to one another. Conventional securing means 42 (such as pins or stakes) may be inserted through the grommets 32 into the substrate or a framework (not shown) at the edge of the barrier 10. It will be appreciated that, if desired, the securing means 42 passing through a grommet 32 of one blanket 12 will pass through an aligned grommet 32 of an adjacent blanket 12 to fix the relative disposition of the two blankets, assuming the two grommets 32 have been appropriately placed on the respective blankets to take into account the desired body overlap.

The substantial flexibility of the blankets 12 enables them to be formed, stored, transported and deployed in larger sizes (e.g., up to 6×50 feet) relative to a conventional more rigid, non-rollable barrier piece which is typically limited to no more than 8 feet in length. Accordingly, the larger blankets of the present invention can more easily and rapidly be installed, thereby saving time and labor expenses.

The blanket configuration can easily be modified to compensate for obstructions, such as pipes, drains and the like, simply using a utility knife or a pair of scissors to trim the blankets about the obstruction, and then applying a moistureproof sealing tape to seal the trimmed area. Such a modification can usually be performed economically at the construction site without the use of special tools (such as the saw or hot knife typically required to modify the configuration of a rigid insulation).

Figure 4:
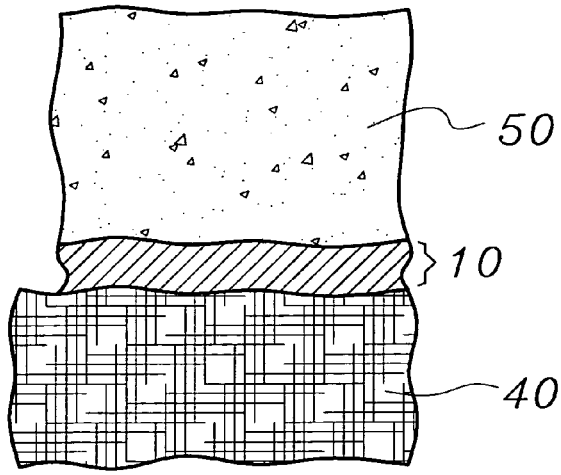
FIG. 4 is a fragmentary sectional view of the seriatim assembly including, in ascending order, the substrate, the barrier, and the concrete slab.

The substantial flexibility of the blanket enables it to be delivered to a construction site in a tight roll and to be so stored at the construction site prior to use. When used, the blanket conforms perfectly to the subsoil, around the foundation, and up a concrete or brick wall. The grommets enable the blankets to be staked down to a substrate or wooden framework, generally designated 40 (see FIG. 4) at the job site in order to prevent them from being blown out of position by ambient winds, etc. The overlapping joints of the barrier provide a relatively attractive finish to the exterior at the construction site, prior to covering of the barrier, and avoid the unsightly appearance of the sealants. The staked-down barrier can be walked on without damage thereto, if desired, since there are essentially no voids beneath the blankets.

The substantially uniform thickness of the barrier enables a relatively even pour of concrete over the barrier 10 (see FIG. 4), thereby to form a concrete slab, generally designated 50, of substantially uniform strength. The overlapping of the edges provides both a very high R-V value and an effective barrier against liquid water, moisture vapor and optionally soil gases (e.g., radon, methane and the like). Aluminum flashing (thicker and more rigid than aluminum foil) may easily be installed over the barrier 10 since the overlapping edges of the blankets cause only a minor variation (typically not exceeding 1.5 inches, the blanket thickness) in the thickness of the barrier.

To summarize, the present invention provides a thermally insulative and waterproof barrier for protecting an exterior surface using a plurality of flexible sheets having overlapping edges, thereby to avoid the extra expense involved with the time, labor and materials required for the sealing of butt joints. The barrier will conform substantially to a subsoil, foundation or wall to provide an operatively continuous barrier, the thermal insulation within the barrier being sealed against attack by moisture. The barrier is simple and inexpensive to manufacture and use.

Now that the preferred embodiments of the present invention have been shown and described in detail, various modifications and improvements therein will become readily apparent to those skilled in the art. Accordingly, the spirit and scope of the present invention is to be construed broadly and limited only by the appended claims, and not by the foregoing specification.

I claim:

1. A seriatim assembly comprising:

(A) a substrate defining an exposed exterior surface;

(B) an intermediate layer of a thermally insulative and waterproof barrier for protecting said exterior surface, said barrier being disposed over said exterior surface and comprising:

a plurality of generally rectangular flexible blankets, each said blanket defining a central body and a peripheral margin about edges of said body, edges of said bodies of adjacent blankets overlapping, each said body including at least one base layer of thermal insulation and two cover layers of waterproof material, said cover layers being sealed together peripherally about said base layer in a substantially gas-tight relationship to form said peripheral margin and to exclude water and water vapor from said base layer; and (C) an outer layer disposed over said intermediate layer and comprising a concrete slab.

2. The assembly of claim 1 wherein said blankets are disposed with adjacent blankets forming only a single pair of mutually overlapping edges.

3. The assembly of claim 1 wherein at least one of said blankets has all four edges overlapping the edges of other blankets.

4. The assembly of claim 1 wherein said peripheral margin of each said blanket is heat-sealed.

5. The assembly of claim 1 wherein said overlapping edges overlap by at least 1.5 inches.

6. The assembly of claim 1 wherein said overlapping edges overlap by not more than 4.0 inches.

7. The assembly of claim 1 additionally including grommets extending through said peripheral margin of each blanket, and securing means extending through at least some of said grommets for securing each said blanket to one of a substrate, said structural frame and another of said blankets.

8. The assembly of claim 1 wherein each said blanket is sufficiently flexible to be rollable into a generally cylindrical configuration.

9. The assembly of claim 1 wherein each said blanket has a thickness of not more than 1.5 inches.

10. The assembly of claim 1 wherein said thermal insulation includes at least one metallized surface of at least one cover layer.

11. The assembly of claim 1 wherein said waterproof material is sheet-like.

12. The assembly of claim 1 wherein said waterproof material is moisture-proof.

13. The assembly of claim 1 wherein said waterproof material is impervious to soil gas.

14. The assembly of claim 1 additionally including a plurality of fixation means extending through each said blanket body to fix the relative position of said base layer relative to said cover layers.

15. A seriatim assembly comprising:

(A) a substrate defining an exposed exterior surface;

(B) an intermediate layer of a thermally insulative and waterproof barrier for protecting said exterior surface, said barrier being disposed over said exterior surface and comprising:

a plurality of generally rectangular flexible blankets, each said blanket defining a central body and a peripheral margin about edges of said body, edges of said bodies of adjacent blankets overlapping, each said body including at least one base layer of substantially non-compressible thermal insulation and two cover layers of waterproof material, said cover layers being heat-sealed together peripherally about said base layer in a substantially gas-tight relationship to form said peripheral margin and to exclude water and water vapor from said base layer; each said blanket being sufficiently flexible to be rollable into a generally cylindrical configuration and having a thickness of not more than 1.5 inches;

said blankets being disposed with adjacent blankets forming only a single pair of mutually overlapping edges, and at least one of said blankets having all four edges overlapping the edges of other blankets, overlapping edges overlapping by at least 1.5 inches and not more than 4.0 inches;

a plurality of fixation means extending through each said blanket body to fix the relative position of said base layer relative to said cover layers; and grommets extending through said peripheral margin of each blanket, and adapted to receive securing means extending through at least some of said grommets for securing each said blanket to one of said substrate, a structural frame and another of said blankets; and (C) an outer layer disposed over said intermediate layer and comprising a concrete slab.

* * * * *